US005481767A

United States Patent [19]

Lewis

[11] Patent Number: 5,481,767

[45] Date of Patent: Jan. 9, 1996

[54] MULTIPURPOSE BEACH BLANKET

[76] Inventor: Joyce D. Lewis, 33362 Astoria, Dana Point, Calif. 92629

[21] Appl. No.: 333,275

[22] Filed: Nov. 2, 1994

[51] Int. Cl.[6] ..... A47G 9/06

[52] U.S. Cl. ..... 5/417; 5/419; 190/2; 224/156

[58] Field of Search ..... 5/413, 417, 419, 5/420; 190/2; 224/156

[56] References Cited

U.S. PATENT DOCUMENTS

| | | | |
|---|---|---|---|
| 1,102,200 | 6/1914 | Miller | 224/156 |
| 1,256,783 | 2/1918 | Fuller | 5/419 |
| 2,898,609 | 8/1959 | Storie | 5/419 |
| 4,154,323 | 5/1979 | Sneider | 5/417 |
| 4,164,275 | 8/1979 | Davis | 5/417 |
| 4,194,601 | 3/1980 | Yellin | 5/419 |
| 4,466,516 | 8/1984 | Sicoli et al. | 190/2 |
| 4,634,618 | 1/1987 | Greer et al. | 5/417 |
| 5,099,530 | 3/1992 | Scott | 5/420 |
| 5,199,120 | 4/1993 | Holmes | 5/417 |
| 5,347,667 | 9/1994 | Schwarz et al. | 190/2 |

*Primary Examiner*—Michael J. Milano
*Attorney, Agent, or Firm*—Francis X. LoJacono

[57] ABSTRACT

A multipurpose blanket that is adapted for use at the beach, picnics and various sporting events, wherein there is provided a pillow and a wraparound support carrier that also defines a storage member, and wherein a wraparound support carrier includes a plurality of storage pockets, a handle and adjustable shoulder straps.

10 Claims, 2 Drawing Sheets

14
38
40
36
41
12
18
44
42
10
15
17
13
45
11
17

38
14
35
46
10
40
35
12
18
47
36

38
50

10
12
40
48
18
36
35

36
18

35
22
24
26
30
10
30
38

MULTIPURPOSE BEACH BLANKET

BACKGROUND OF THE INVENTION

1. Field of the Invention

The present invention relates generally to a blanket and more particularly to a multipurpose blanket that is adapted for use at the beach, picnics and various sporting events, wherein there is provided a pillow and a wraparound storage member that defines a support having a plurality of storage pockets.

2. Description of the Prior Art

Many types of beach towels and blankets are known in the art and some of these towels and blankets are presently in use. However, there various configurations, structures and designs often limit or restrict their use. That is, beach towels are generally designed to be used by only a single individual to lie on and are seldom used for toweling. Accordingly, they are not generally provided with storage pockets. If they are, however, the pockets often take up space that is needed for one to comfortably lie in a relaxed positioned for resting or for basking in the sun. This is also true for blankets that are also provided with several large storage compartments or pockets.

Then there is the additional problem with sand that will inevitably find its way into the storage compartments or pockets which must be cleaned out before the blanket or towel can be folded and stored.

As examples of such blankets, towels or mats and the like, one may refer to the following patents.

In U.S. Pat. No. 2,344,010, issued to H. B. Walsh, there is disclosed a combination beach robe, towel and receptacle that is formed having a zipper fixedly secured to one side of the towel so as to define a compartment area.

In U.S. Pat. No. 3,222,698, issued to S. S. Brown, there is disclosed a kindergarten rest mat that is adapted to be rolled into a self-contained package for storing.

In U.S. Pat. No. 4,154,323, issued to J. A. Sneider, there is disclosed a multipurpose bag that is intended for holding a flexible strip of material detachably secured to an inner portion of the bag.

U.S. Pat. No. 4,634,618, issued to K. B. Greer, et al, there is disclosed an ordinary beach towel or picnic blanket provided with a means to hold it secure in the wind. A hidden weighted cord sewn into the perimeter holds the material in place.

In U.S. Pat. No. Des. 317,995, issued to A. M. Crowley-McGregor, there is disclosed a towel having pockets mounted thereon.

In U.S. Pat. No. 5,072,467, issued to S. P. Hunt, there is disclosed a beach towel that includes closeable envelopes and pockets behind the envelopes. These envelopes and/or pockets can be used as receptacles for sand in order to hold down the beach towel and form a pillow.

One may also refer to the German Patent 819,449, which discloses a resting mat having an integral air pillow that is inflatable. When the mat is folded it forms a carrying bag.

SUMMARY AND OBJECTS OF THE INVENTION

It is therefore an important object of the present invention to provide a multipurpose blanket which is more particularly arranged for use as a beach blanket that includes a pillow and a wraparound support carrier that defines a means to carry and store the blanket which also includes a plurality of storage pockets formed therein.

Another object of the present invention is to provide a multipurpose blanket of this type wherein the wraparound support member is formed with handle straps and an adjustable pair of shoulder straps.

Still another object of the present invention is to provide a multipurpose blanket of this character wherein the wraparound support member can be used as an elongated side member that is adapted to be removably attached to the blanket when in an unfolded position for use, whereby the storage pockets arranged thereon can be easily accessed without disturbing the blanket.

A further object of the invention is to provide a beach blanket or the like that is simple in structure so as to be easily folded and stored with a pillow when wrapped in the elongated support member, and wherein the shoulder straps allow the blanket and pillow to be carried as a backpack.

Still another object of the present invention is to provide a blanket of this character that is designed to be easily used, maintained and stored, and is relatively inexpensive to manufacture since all storage pockets and the like are located within the elongated support member.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

With the above and related objects in view, the invention consists in the details of construction and combination of parts, as will be more fully understood from the following description, when read in conjunction with the accompanying drawings and numbered parts.

DESCRIPTION OF THE PREFERRED EMBODIMENT

Figure 1:
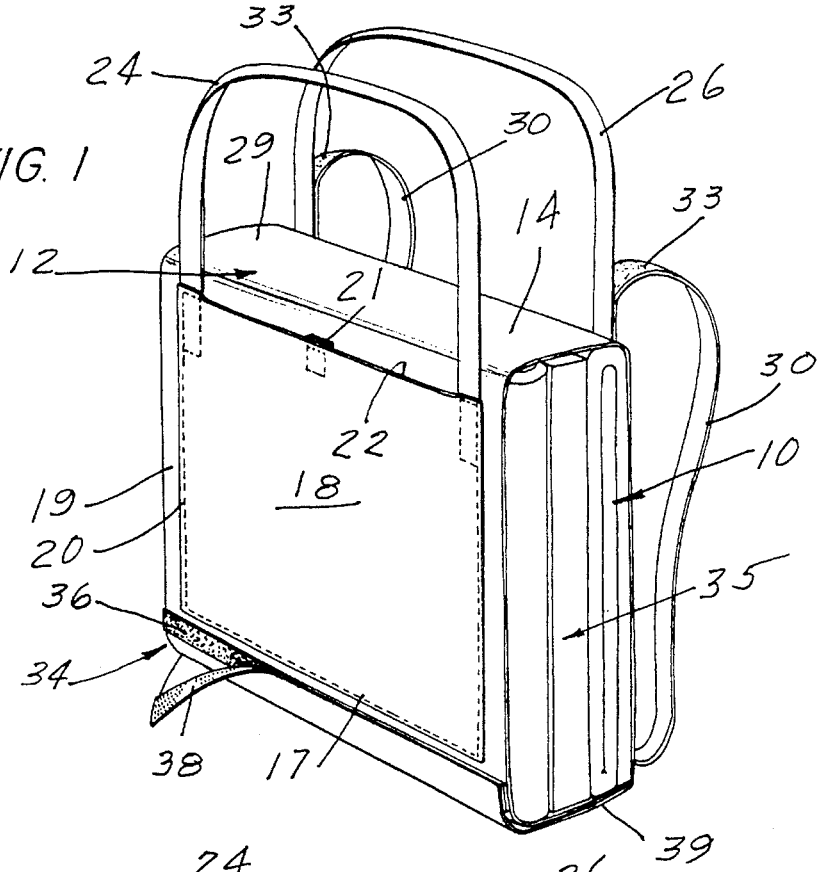
FIG. 1 is a perspective view of the present invention illustrating the side thereof on which an enlarged pocket is provided and wherein the folded blanket and pillow are stored in the wraparound support carrier.
Figure 2:
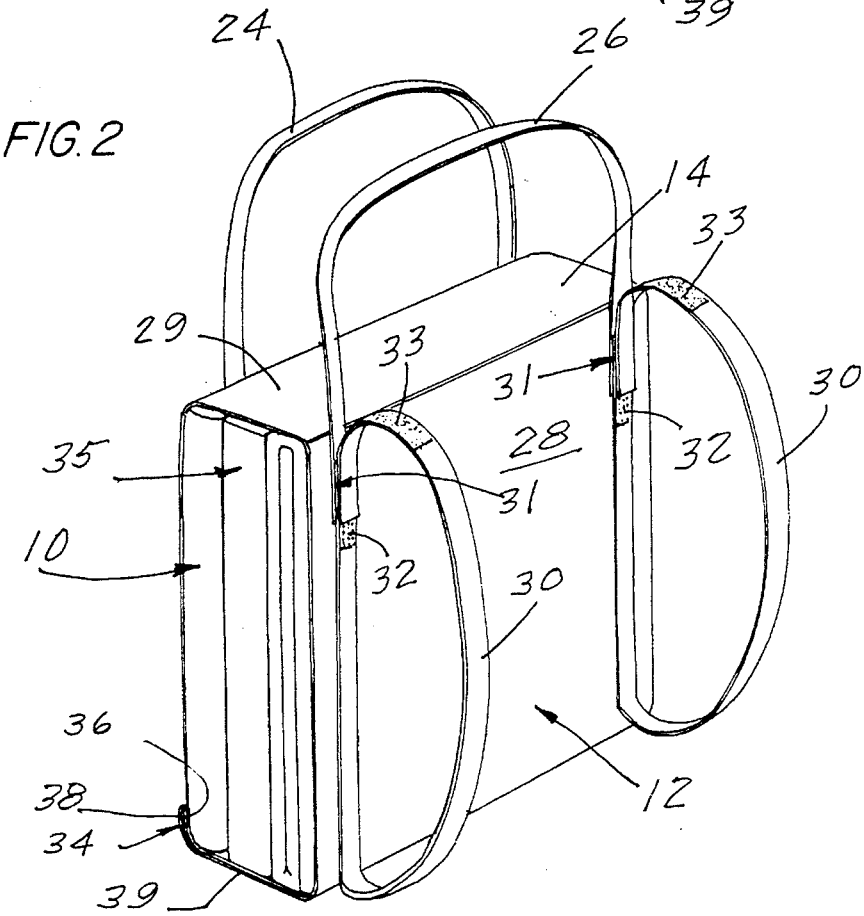
FIG. 2 is another perspective view looking at the opposite side thereof that includes the adjustable shoulder straps for carrying on one's back.

Referring more particularly to FIGS. 1 and 2, there is illustrated a multipurpose blanket, generally indicated at 10, having a wraparound support carrier, indicated at 12, which further defines a storage means in which the folded blanket 10 is stored.

The wraparound support carrier 12 comprises an elongated strip of material 14 having a top edge and a bottom edge, and a length that is approximately 39 to 42 inches and a width between 15 to 16 inches. The strip material 14 is preferably made from the same or similar material as blanket 10 such as cotton, wool or the combination thereof or other suitable water-resistant materials.

In both FIGS. 1 and 2, the outer side of the wraparound support carrier is shown having an enlarged storage pocket 18 that is attached to a selected area of the support carrier so that pocket 18 will always be positioned for ease of access from the front of a first designated panel 19 when wrapped around the blanket 10. This pocket is shown as being sewn along its bottom and both sides, indicated by threads 20, defining an upper open end 22 having a central securing means 21 comprising any suitable closing device but preferably a Velcro® hook-and-loop material.

Attached to the outer edges of the pocket at the open end thereof is a narrow strip of suitable material that defines a handle 24 which corresponds to the matching handle 26 which is attached to a selected area of the rear designated second panel 28 opposite from that indicated as first panel 19, the first and second panels being separated by a top smaller third panel 29. Second panel 28 also includes a pair of adjustable shoulder straps 30 which are removably fastened by suitable means 31 to the respective ends of handle 26, said fastening means being preferably defined by hook-and-loop materials 32 and 33, respectively, that define one of many types of adjustable fastening means. First, second, third and forth panels 18, 28, 29 and 39, respectively, are formed only when the elongated strip of material 14 is wrapped around blanket 10 and pillow 35, as illustrated in FIGS. 1 and 2.

There is also illustrated in FIG. 1 another fastening means, generally indicated at 34, which is preferably shown as a Velcro®-type material having a strip of loop material 36 and a matching strip of hook material 38, the strip of loop material 36 is shown as being positioned on the outer side of wraparound support carrier 12 adjacent to closed end 17 of pocket 18.

The hook material 38 is shown transversely positioned along the terminal end of the bottom panel 39 on the inner side of the wraparound support carrier 12. It should be noted that the hook-and-loop materials can be interchangeably positioned.

Referring now to FIGS. 3 through 6, there is shown an inner pocket 40 that is formed on the inner side of the wraparound support carrier 12. However, a plurality of various sizes of pockets are contemplated. These same FIGS. 3–6 show various stages of a method for folding the blanket 10 and the wraparound support carrier 12 so as to define both a carrier means and a storage means for blanket 10 and pillow 35.

Figure 3:
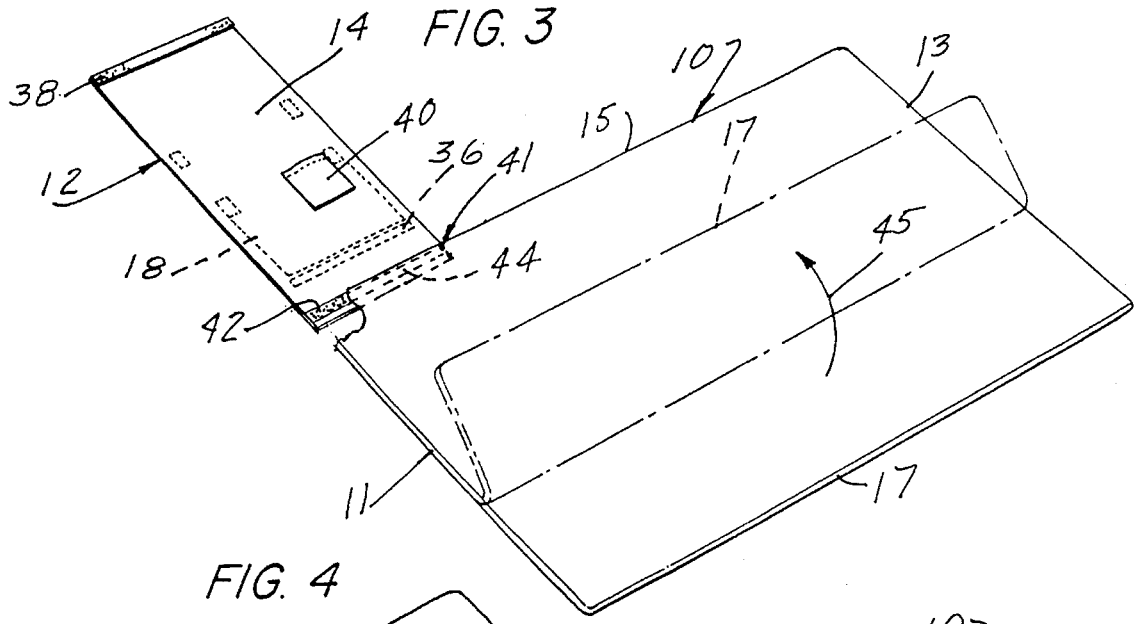
FIG. 3 is a pictorial view of the blanket in a spread-out position with the support carrier attached to one edge of the blanket.

In FIG. 3 blanket 10 is spread out in a fully open position, wherein the blanket is shown having a substantially rectangular configuration, although a square arrangement would also be suitable for use with the present invention. That is, the blanket is formed having four sides that define a top edge 11, a bottom edge 13, a left edge 15, and a right edge 17. When in actual use, the wraparound support carrier 12 is attached to the left edge 15 of the blanket, as indicated at 41, and corresponding loop and hook fastening strips 42 and 44 are provided. Fastening strip 42 is fixedly attached transversely along the inner bottom edge of the material that defines the wraparound support carrier 12, the second cooperating fastening strip 44 being fixedly attached to edge 41 adjacent one corner of the blanket.

The method of folding blanket 10 and wraparound support carrier 12 comprises the steps of folding the blanket in equal longitudinal sections, as indicated by arrow 45. Accordingly, the number of folds depends on the size of the blanket. The folding starts from the right edge 17 and folds towards the left edge 15, in the direction of arrow 45. The attachment of the wraparound support carrier is preferably done before the folding of the blanket but can also be accomplished after folding. When this folding is complete it will look similar to that illustrated in FIG. 4. The blanket is then folded over several times in the direction as indicated by arrows 46 and 47, along the longitudinal length thereof, that is, starting from the bottom edge 13 towards the top edge 11.

Figure 4:
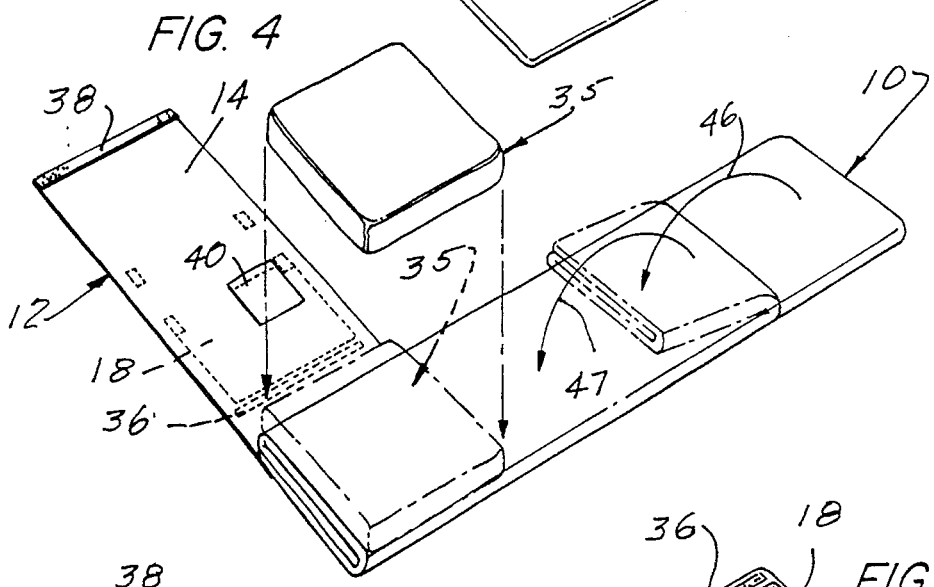
FIG. 4 is a pictorial view of the blanket folded prior to the pillow being positioned thereon.
Figure 5:
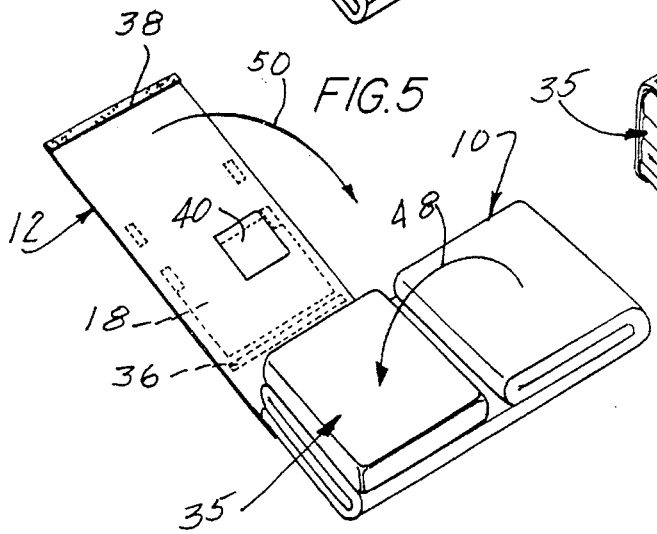
FIG. 5 is a pictorial view of the blanket folded and the pillow positioned thereon prior to the last folding of the blanket.
Figure 6:
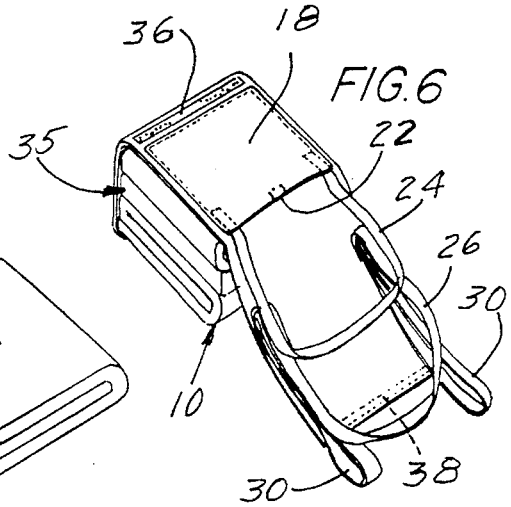
FIG. 6 is a pictorial view of the blanket and pillow being wrapped within the support carrier.

However, prior to the last fold pillow 35 is placed on the folded blanket in line with the wraparound support carrier. The width of the pillow should correspond to the width of the support carrier, as illustrated in FIGS. 4 and 5. In FIG. 5 the blanket is folded over pillow 35, as indicated by arrow 48, at which time the folding steps are completed and the support carrier is then wrapped around the blanket and pillow, as shown in FIG. 5 by arrow 50, so that fastening strip 38 is secured to fastening strip 36 as mentioned heretofore. The folded blanket 10 and pillow 35 are now stored and can be carried by handles 24 and 26 or by positioning straps 30 on one's shoulders.

The foregoing should only be considered as illustrative of the principles of the invention. Further, since numerous modifications and changes may readily occur to those skilled in the art, it is not desired to limit the invention to the exact construction and operation as shown and described, and accordingly, all suitable modifications and equivalents may be resorted to, falling within the scope of the claimed invention.

What I claim is:

1. A multipurpose blanket comprising:

a blanket having a quadrilateral configuration that includes a left edge and a right edge defining the width of said blanket, and a top edge and a bottom edge defining the length of said blanket;

a wraparound support carrier formed by an elongated piece of material, said wraparound support carrier being formed with a top edge and a bottom edge, and outer and inner sides; and wherein at least one pocket is formed on the outer side and on the inner side of said wraparound support carrier;

a pillow having a width equal or less than the width of said wraparound support carrier;

a first fastening means having first and second fastening members, wherein said first fastening member is transversely mounted on said inner side of said bottom edge of said wraparound support carrier, and wherein said second fastening member is mounted along at least one side edge of said blanket, whereby said wraparound support carrier is removably attached to said blanket adjacent one corner thereof; and a second fastening means having a first fastening member mounted transversely on said inner side of said top edge of said wraparound support carrier, and a second fastening member mounted transversely on said outer side of said wraparound support carrier, whereby said wraparound support carrier is wrapped around said blanket and said pillow for carrying and storage thereof.

2. The multipurpose blanket as recited in claim 1, wherein said wraparound support carrier further defines a storage means.

3. The multipurpose blanket as recited in claim 2, wherein said wraparound support carrier includes means for carrying said wraparound support carrier when said blanket and pillow are stored therein.

4. The multipurpose blanket as recited in claim 3, wherein said carrier means comprises a pair of handle straps secured to said wraparound support carrier.

5. The multipurpose blanket as recited in claim 3, wherein said carrier means comprises a pair of handle straps and a pair of adjustable shoulder straps.

6. The multipurpose blanket as recited in claim 5, wherein the length of said wraparound support carrier is approximately 39 to 42 inches and the width thereof between 15 to 16 inches.

7. The multipurpose blanket as recited in claim 5, wherein said blanket is formed from a cloth material.

8. The multipurpose blanket as recited in claim 7, wherein at least one side of said blanket is water resistant.

9. A method of folding a blanket and wrapping said blanket with a wraparound support carrier, comprising the steps of:

folding said blanket along the width thereof to define a plurality of folded elongated sections;

folding said folded elongated sections along the length thereof to define a plurality of substantially square folded sections;

placing a pillow on said folded elongated sections prior to folding the last square folded section so as to be sandwiched between said folded sections of the folded blanket;

wrapping said wraparound support carrier around said folded blanket and said pillow; and securing said wraparound support carrier in place around said folded blanket.

10. A method of folding a blanket and wrapping said blanket with a wraparound support carrier, comprising the steps of:

securing the lower end of said wraparound support carrier to one of the longitudinal edges of said blanket;

folding said blanket along the width thereof to define a plurality of folded elongated sections;

folding said folded elongated sections along the length thereof to define a plurality of substantially square folded sections;

placing a pillow on said folded elongated sections prior to folding the last square folded section so as to be sandwiched between said folded sections of the folded blanket; and wrapping said wraparound support carrier around said folded blanket and said pillow and securing said upper end of said wraparound support carrier adjacent to said lower end thereof.

* * * * *